US007771010B2

(12) United States Patent
Moscato et al.

(10) Patent No.: US 7,771,010 B2
(45) Date of Patent: Aug. 10, 2010

(54) APPARATUS FOR PRINTING USING A PLURALITY OF PRINTING CARTRIDGES

(75) Inventors: Anthony V. Moscato, North Tonawanda, NY (US); Dan E. Kanfoush, Niagara Falls, NY (US)

(73) Assignee: RR Donnelley, Chicago, IL (US)

( * ) Notice: Subject to any disclaimer, the term of this patent is extended or adjusted under 35 U.S.C. 154(b) by 697 days.

(21) Appl. No.: 11/701,802

(22) Filed: Feb. 2, 2007

(65) Prior Publication Data

US 2007/0200895 A1 Aug. 30, 2007

Related U.S. Application Data

(60) Provisional application No. 60/765,353, filed on Feb. 3, 2006.

(51) Int. Cl.
*B41J 2/145* (2006.01)
*B41J 2/21* (2006.01)
*B41J 2/14* (2006.01)

(52) U.S. Cl. ..... 347/40; 347/43; 347/49

(58) Field of Classification Search ..... 347/40, 347/43, 49, 12, 13, 20, 41, 42
See application file for complete search history.

(56) References Cited

U.S. PATENT DOCUMENTS 4,025,925 A 5/1977 Jensen et al.
4,288,799 A 9/1981 Uzawa et al.
4,531,828 A 7/1985 Hoshino
4,709,246 A 11/1987 Piatt et al.
4,709,247 A 11/1987 Piatt et al.
4,755,836 A 7/1988 Ta et al.
4,785,734 A 11/1988 Kawana et al.
4,812,859 A 3/1989 Chan et al.
4,878,063 A 10/1989 Katerberg
5,057,854 A 10/1991 Pond et al.
5,059,984 A 10/1991 Moore et al.
5,111,220 A 5/1992 Hadimioglu et al.
5,121,130 A 6/1992 Hempel et al.

(Continued)

FOREIGN PATENT DOCUMENTS

EP 677 387 10/1995

(Continued)

OTHER PUBLICATIONS

International Search Report and Written Opinion in PCT/US2007/003238 dated Nov. 12, 2008.

(Continued)

*Primary Examiner*—Stephen D Meier
*Assistant Examiner*—Rene Garcia, Jr.
(74) *Attorney, Agent, or Firm*—McCracken & Frank LLP

(57) ABSTRACT

An apparatus has a plurality of printing cartridges to reproduce an image, wherein each printing cartridge prints a portion of the image onto a substrate. The apparatus further includes a media transport for moving the substrate parallel to a first dimension. The printing cartridges are disposed on a carrier in a two dimensional pattern such that the plurality of printing cartridges are able to print on the substrate a line that is perpendicular to the first dimension. Fewer than half of the plurality printing cartridges that print segments of the line that abut each other are adjacent to each other along the first dimension.

17 Claims, 8 Drawing Sheets

U.S. PATENT DOCUMENTS 5,192,959 A 3/1993 Drake et al.
5,241,325 A 8/1993 Nguyen
5,289,208 A 2/1994 Haselby
5,365,847 A 11/1994 Pers
5,376,958 A 12/1994 Richtsmeier et al.
5,408,746 A 4/1995 Thoman et al.
5,428,375 A 6/1995 Simon et al.
5,461,405 A 10/1995 Lehmann et al.
5,696,544 A * 12/1997 Komuro ..... 347/50
5,751,303 A 5/1998 Erickson et al.
5,765,481 A 6/1998 Tortora et al.
5,782,184 A 7/1998 Albertalli et al.
5,793,397 A 8/1998 Barker et al.
5,796,411 A 8/1998 Cyman et al.
5,797,305 A 8/1998 Harrod et al.
5,806,430 A 9/1998 Rodi
5,808,635 A 9/1998 Kneezel et al.
5,838,343 A 11/1998 Chapin et al.
5,946,011 A 8/1999 Kanaya
5,949,438 A 9/1999 Cyman et al.
6,003,988 A 12/1999 McCann et al.
6,065,400 A 5/2000 Van Weverberg
6,068,367 A 5/2000 Fabbri
6,120,142 A 9/2000 Eltgen et al.
6,213,580 B1 4/2001 Segerstrom et al.
6,224,192 B1 5/2001 Robinson et al.
6,234,605 B1 5/2001 Hilton
6,250,738 B1 6/2001 Waller et al.
6,253,678 B1 7/2001 Wentworth
6,299,287 B1 * 10/2001 Williams et al. ..... 347/43
6,302,517 B1 10/2001 Kanaya
6,336,722 B1 1/2002 Wotton et al.
6,375,296 B1 4/2002 McGarry et al.
6,386,668 B1 5/2002 Shimizu et al.
6,422,678 B1 7/2002 Serra et al.
6,450,607 B1 9/2002 Bolash et al.
6,460,441 B1 10/2002 Harrod
6,467,874 B1 10/2002 Williams
6,471,335 B1 10/2002 Gelbart
6,530,647 B2 * 3/2003 Kubota et al. ..... 347/43
6,592,200 B2 7/2003 Wotton et al.
6,592,276 B2 7/2003 Ohba et al.
6,637,860 B1 10/2003 Madeley
6,688,721 B1 2/2004 Serra
6,789,876 B2 9/2004 Barclay et al.
6,789,879 B2 9/2004 Khalid
6,890,061 B1 5/2005 Freire et al.
7,073,882 B2 7/2006 Kim et al.
7,083,255 B2 8/2006 Shibata et al.
7,093,926 B2 8/2006 Gil
7,431,428 B2 10/2008 Yamada
2005/0140722 A1 6/2005 Shibata et al.
2005/0270329 A1 12/2005 Hoisington et al.
2006/0008296 A1 1/2006 Sampe et al.

FOREIGN PATENT DOCUMENTS

JP A-2004-255335 9/2004

OTHER PUBLICATIONS

International Preliminary Report on Patentability in PCT/US2007/003238 dated Dec. 11, 2008.
European Search Report in Application No. 07763342.8 dated Jun. 18, 2009.
European Search Report in Application No. 07763342.8-1251 dated Nov. 23, 2009.
Paper filed on Feb. 1, 2010 by Serjeants, our Agent, in response to the European Search Report in Application No. 07763342.8-1251 dated Nov. 23, 2009, which was cited in the 6th Supplemental IDS dated Dec. 12, 2009.
Office Action in Application No. 200780004469.0, and Letter received from Shanghai Zhi Xin Patent Agent Ltd., dated Apr. 2, 2010.

* cited by examiner

APPARATUS FOR PRINTING USING A PLURALITY OF PRINTING CARTRIDGES

CROSS REFERENCE TO RELATED APPLICATIONS

This application claims the benefit of U.S. Provisional Application Ser. No. 60/765,353, filed Feb. 3, 2006, and incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to printing systems and more particularly to a system that uses a plurality of printing cartridges for high-speed printing.

2. Description of the Background of the Invention

Ink jet printing systems use ink jet cartridges that propel a drop of ink to a substrate, such as paper. Some ink jet printing system use a traversing print head, where a print head traverses the width of the paper dropping one or more lines of ink to form a swath of an image along the width of the paper. Upon completion of the swath, the paper is advanced in accordance with the width of the swath and the print head traverses the width of the paper to print a next swath. Traversing head printing systems are generally slower and are used in applications where print speed is not of great importance.

Other ink jet printing systems use a single fixed printing head. The paper advances under the printing head and the nozzles of the printing head eject drops of ink onto the paper in accordance with the position with paper to print an image. These types of ink jet printing systems are capable of higher print speeds than printing systems which use traversing heads; however, these systems generally use a relatively narrow printing head and, thus are used in applications where a relatively narrow, 1 to 2 inches (2.54-5.08 cm), image is required. Printing heads with larger widths are not commonly used because of the complexity of manufacture and because the entire printing head has to be replaced if any nozzles therein fail.

To overcome the speed short comings of the traversing head printing systems and the print width limitations of the fixed head printing systems, printing systems have been developed that stitch images printed by multiple, small, fixed printing heads. Typical printing heads comprise nozzles and require more area than necessary for the nozzles. The additional area is needed for mounting points, ink delivery tubing, drive electronics, etc. As such, two printing heads that are to print adjoining portions of an image cannot simply be mounted onto a frame or a carrier abutted against one another. Instead, printing heads are typically mounted onto a carrier in a two dimensional fashion. FIG. 1 shows a carrier 100 having printing cartridges 102 A-F mounted thereon. Each of the printing cartridges 102-A through 102-F comprise print heads 104-A through 104-F, respectively, wherein, each print head comprises a number of nozzles controllable to print a swath of an image. Each nozzle in the printing cartridge is controlled individually to eject a drop of ink onto a substrate

106. In operation, the substrate 106 is transported past the printing cartridges 102 in the direction indicated by the arrow A, while the nozzles that comprise each print head 104 are controlled to eject ink onto the substrate to print a swath in a direction parallel to the paper transport direction (arrow A). The swaths are printed abutting one another to print a stitched image of width $W_1$ (and represented in FIG. 1 by a line of text 108. The carrier shown in FIG. 1 has a length of D that is at least sufficient to accommodate the number of printing cartridges required to print an image of width $W_1$. Typical printing cartridges are able to print between 1 to 1.5 inch (2.54-3.81 cm) swaths. Using such printing cartridges in the configuration shown in FIG. 1 would enable printing of images that have a width $W_1$ of 6 to 9 inches (15.24-22.86 cm).

FIG. 2 shows an arrangement of printing cartridges 202 A-F and 204 A-F on a carrier 200 that has a length D for printing an image that has a width $W_2$, that is twice the width of the image printed by the arrangement of printing cartridges shown in FIG. 1. Specifically, a first group of six printing cartridges 202 A-F prints a first portion of the image having a width $W_1$ and a second group of six printing cartridges 204 A-F prints a second portion of the image that also has width $W_1$. The two groups printing in concert can produce a stitched image with a width $W_2$. As described above in connection with FIG. 1, the substrate 206 is transported past the carrier 200 in the direction shown by arrow A such that the nozzles comprising the printing cartridges 202 A-F and 204 A-F eject ink thereon to print an image (illustrated as the line of characters 208). The configuration of FIG. 2 enables printing of images that have a width $W_2$ of between 12 and 18 inches (30.48-40.72 cm), (if each printing cartridge prints a swatch of between 1 to 1.5 inches, i.e., 2.54-3.81 cm).

The printing cartridges 202 A-F are typically distributed on the carrier 200 in the dimension parallel to the direction A such that the distance between centers of each pair of printing cartridges that print adjacent swaths of the image (e.g., printing cartridges 202-A and 202-B) is equal to the inter-head distance $d_1$, which is the distance between adjacent printing cartridges. As shown in FIG. 2, printing cartridges 202-F and 204-A print adjacent swaths of the image; however, the distance between these printing cartridges is five times the inter-head distance $d_1$ and, therefore, there are four printing cartridges between cartridge 202-F and 204-A in the direction parallel to arrow A.

Alignment errors or errors in the transport of the substrate 206 may cause a misalignment (i.e., a stitching error) between two swaths of an image that are stitched. If such a misalignment is relatively small, there may not be any perceptible error in the image of the stitched swaths printed by two printing cartridges, especially if the distance between the two printing cartridges is relatively small. In particular, if the distance between the pair of printing cartridges that print abutting swaths of an image is equal to the inter-head distance $d_1$ then a misalignment error between the cartridges may not result in a perceptible error in the stitching error. As shown in FIG. 2, when the two printing cartridges that print abutting swaths are members of the same group (either 202 A-F or 204 A-F) of printing cartridges, the distance therebetween is $d_1$ (and there are no cartridges between them). The possibility of a perceptible stitching error is significantly greater if the misalignment occurs between two printing cartridges that print abutting swaths, where the two printing cartridges are members of different groups (i.e., between printing cartridges 202-F and 204-A). Decreasing the distance between pairs printing cartridges that print abutting swaths of the image reduces this possibility of perceptible stitching error.

SUMMARY OF THE INVENTION

An apparatus for printing that includes a first plurality of printing cartridges comprising at least three cartridges and a carrier for mounting the first plurality of printing cartridges. The first plurality of printing cartridges are disposed on the carrier in a first and a second group of printing cartridges, wherein the cartridges comprising each group are distributed on the carrier in a two dimensional pattern such that at least two cartridges disposed in each pattern and that print abutting segments of a line along a first dimension are separated in a second dimension by a third cartridge and wherein the pattern in which the cartridges of the first group are distributed is substantially identical to the pattern in which the cartridges of the second group are distributed. The apparatus also includes a media transport for moving a substrate parallel to the second dimension. The maximum number of cartridges separating any two cartridges that print abutting line segments is less than half of the number of the first plurality of printing cartridges.

DETAILED DESCRIPTION OF THE PREFERRED EMBODIMENTS

Figure 1:
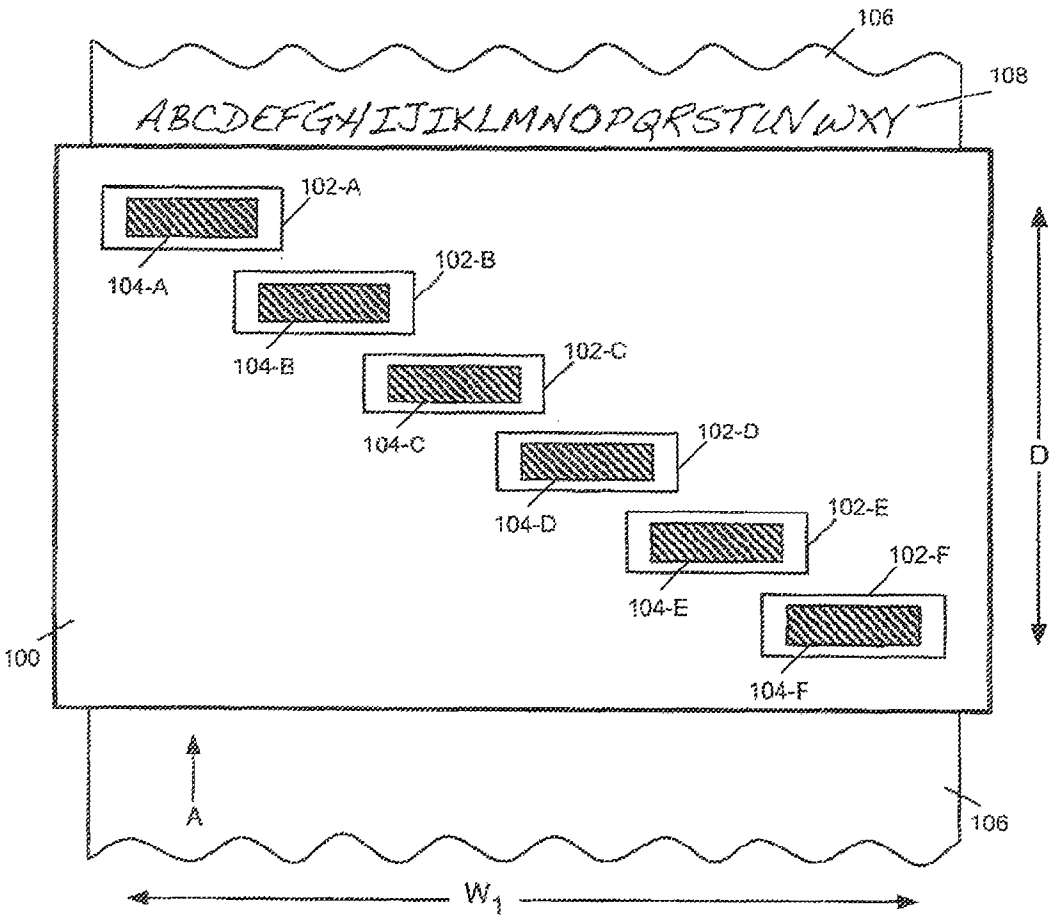
FIG. 1 (PRIOR ART)
FIG. 1 shows a prior art arrangement of printing cartridges on a carrier.
Figure 2:
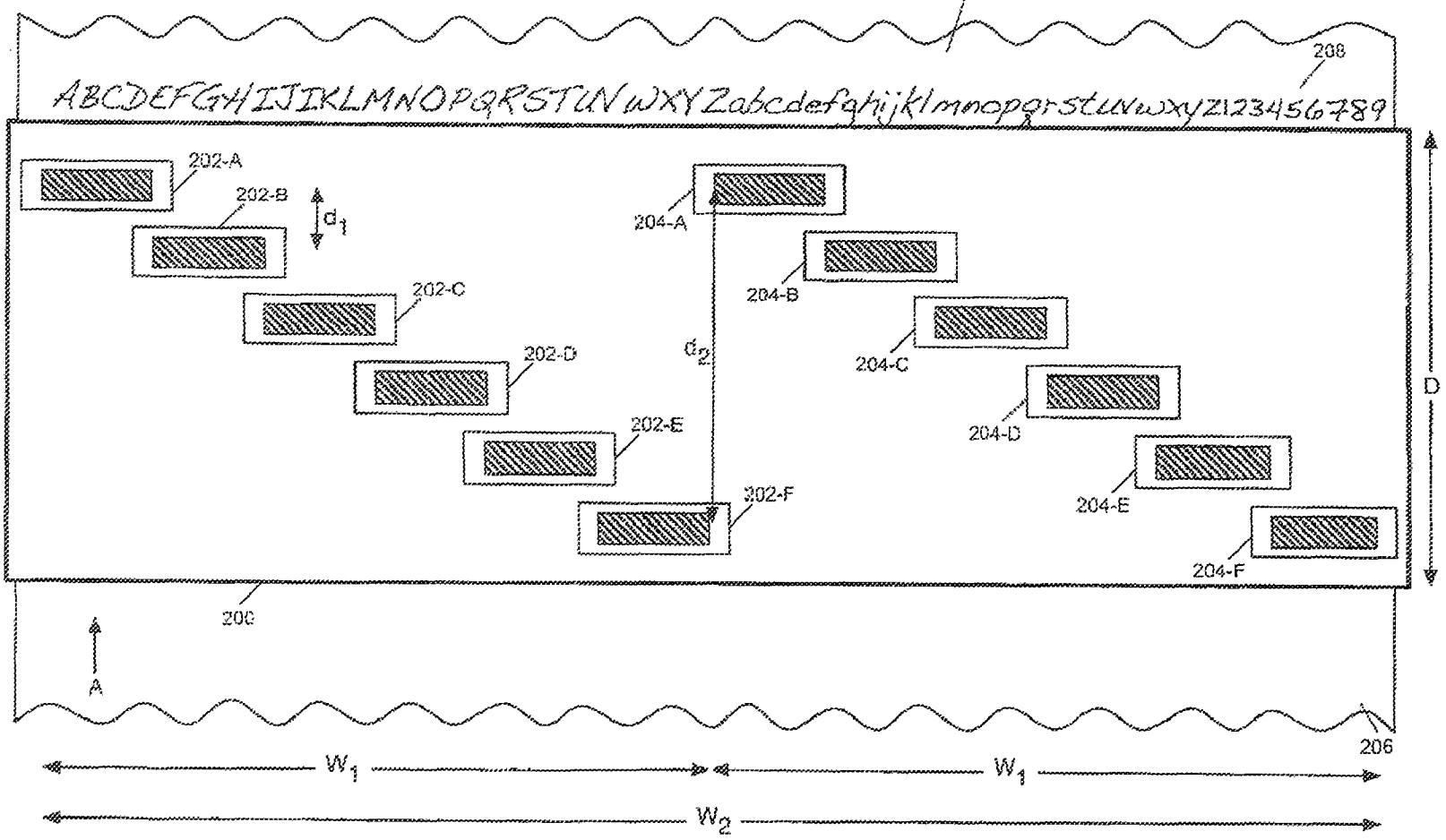
FIG. 2 (PRIOR ART)
FIG. 2 shows another prior art arrangement of printing cartridges on a carrier.
Figure 3:
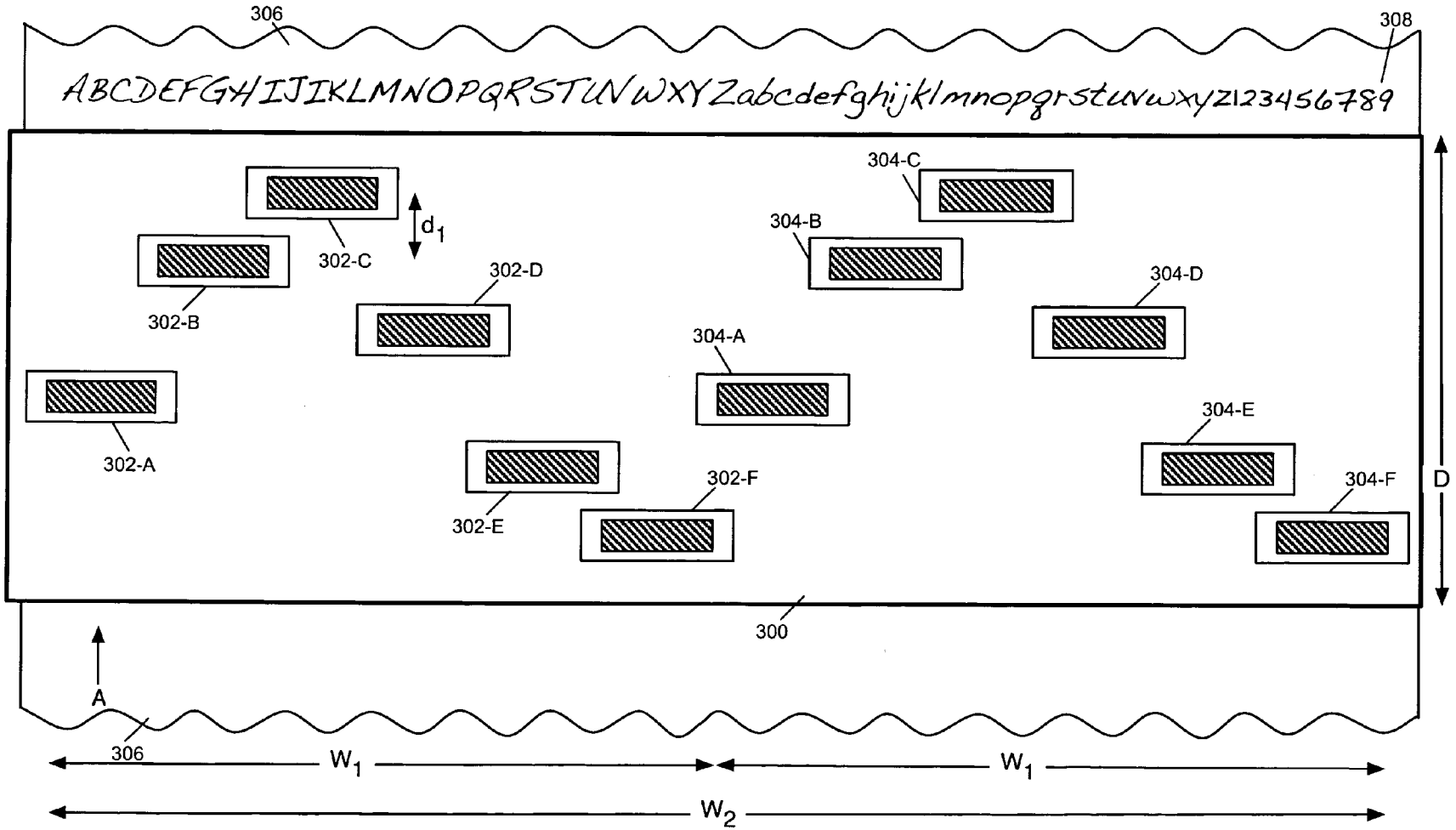
FIG. 3 shows an embodiment of a printing carrier having printing cartridges arranged thereon.

FIG. 3 shows a carrier 300 having an arrangement of two groups of printing cartridges 302 A-F and 304 A-F. The maximum distance between any pair of the printing cartridges 302 A-F and 304 A-F that print abutting swaths is two times the inter-head distance $d_1$. As was discussed above with reference to FIG. 2, reducing the distance between printing cartridges that print abutting swaths also reduces the stitching error. In particular, the distance between printing cartridge 302-F and 304-A is twice the inter-head distance $d_1$ instead of five times $d_1$ as was the case in the configuration shown in FIG. 2. If the print width produced by the individual printing cartridges 202 A-F and 204 A-F used in the configuration shown in FIG. 2 is identical to the print width individual printing cartridges 302 A-F and 304 A-F, then the maximum width of the image printed by the combination of the cartridges in FIG. 3 is identical to the maximum width of the image produced using the arrangement of the printing cartridges shown in FIG. 2. Arranging cartridges on a carrier such that the number of printing cartridges disposed (in the direction parallel to arrow A) between any two printing cartridges that print abutting swaths of an image is less than the half the number of cartridges in each group affords a reduction in the possibility of stitching error.

Figure 4:
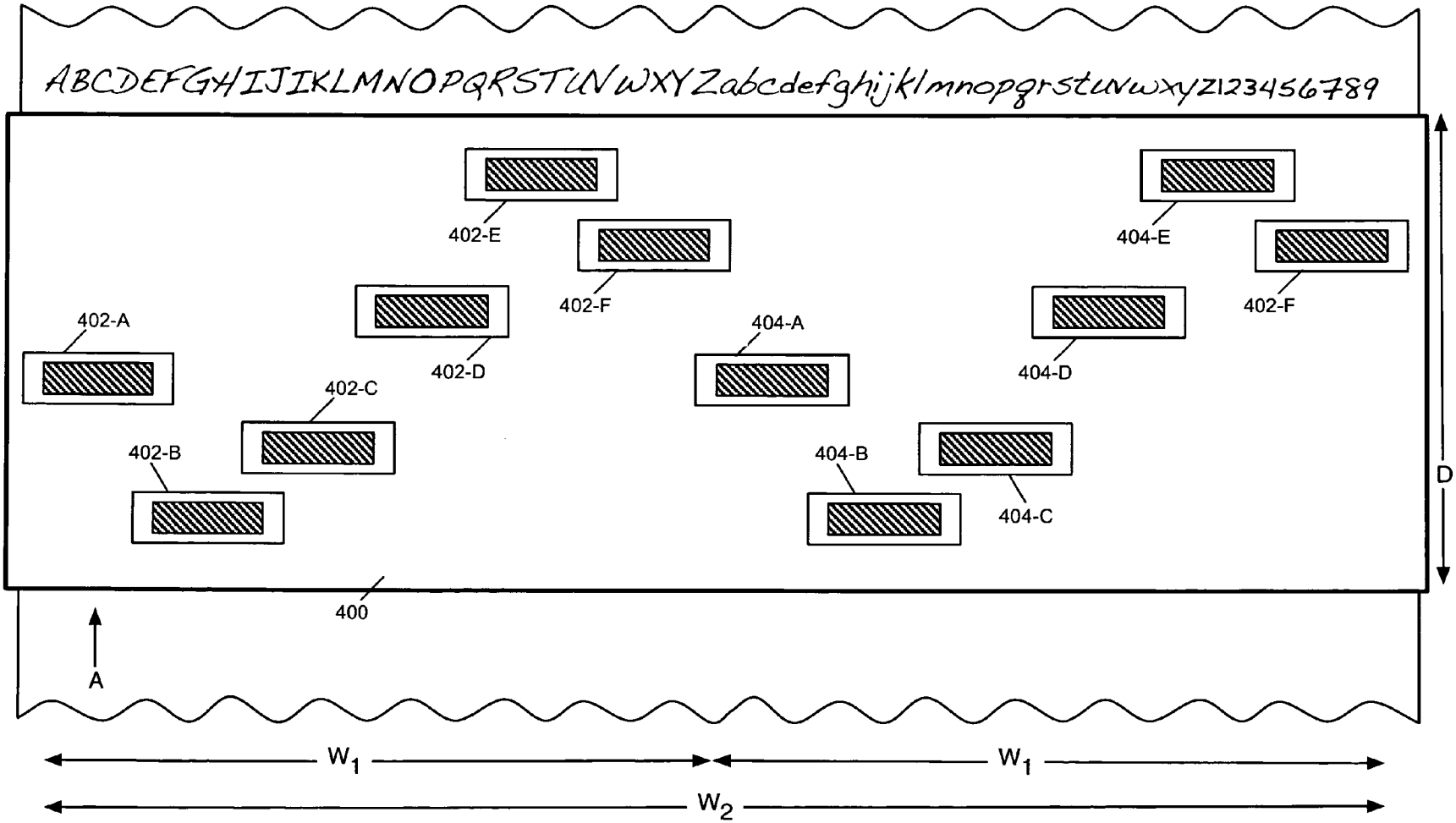
FIG. 4 shows another embodiment of a printing carrier having printing cartridges arranged thereon.

FIG. 4 shows another way of disposing two groups of six cartridges to print a stitched image that has a width identical to that possible by the configurations shown in FIGS. 2 and 3. The maximum distance between two heads in the paper transport direction is two times the inter-head distance $d_1$. It should be apparent to those skilled in the art, that other configurations are possible to minimize the distance between printing cartridges that print abutting swaths.

Figure 5:
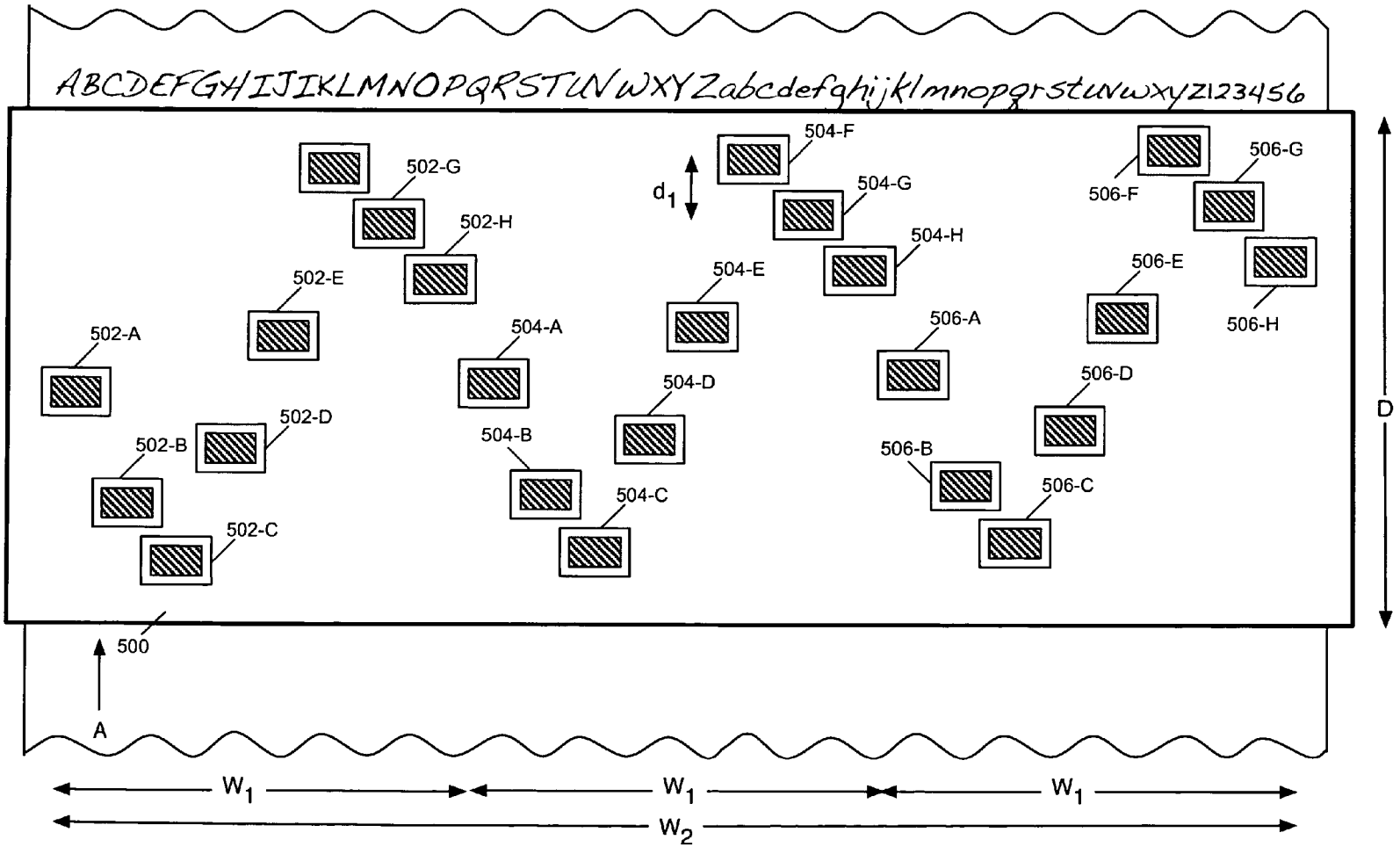
FIG. 5 shows yet another embodiment a carrier on which printing cartridges are arranged.

FIG. 5 shows a configuration of three groups on a carrier 500, wherein each group comprises eight printing cartridges 502 A-H, 504 A-H, and 506 A-F. The printing cartridges 502, 504, and 506 are disposed to minimize the distance between any pair of printing cartridges. In this configuration, the maximum distance between a pair printing cartridges that print abutting swaths is three times the inter-head distance $d_1$. If each of the cartridges is able to print 1 to 1.5 inches (2.54-2.81 cm), then this configuration allows a maximum image width between 24 and 36 inches (60.96-91.44 cm).

Although the configurations shown in FIGS. 3 and 4 show the distribution of two groups of six printing cartridges on a carrier to minimize the effects of misalignment and transport errors on stitched portions of printed images, other distributions of printing cartridges will be apparent to those skilled in the art. Similarly, FIG. 5 shows one arrangement of three groups of eight cartridges on a carrier, and other arrangements should be apparent to those skilled in the art. Furthermore, other arrangements of two or more groups of cartridges will be apparent, where the number of cartridges disposed between any two cartridges that print adjacent or abutting swaths is less than half the number of cartridges that comprise the group.

Figure 6A:
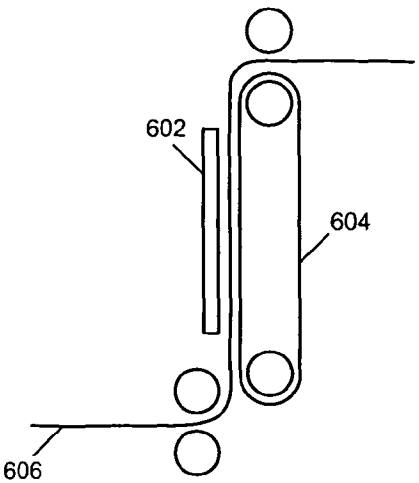
FIGS. 6A-C are schematic diagrams of an embodiment of a printing system that uses an embodiment of the carrier depicted in FIGS. 1-5.
Figure 6B:
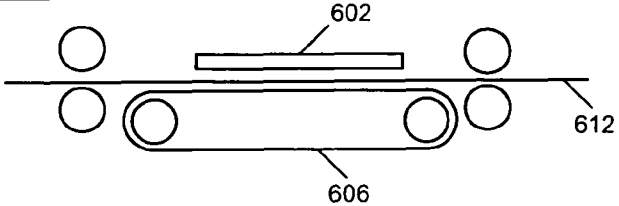
Figure 6C:
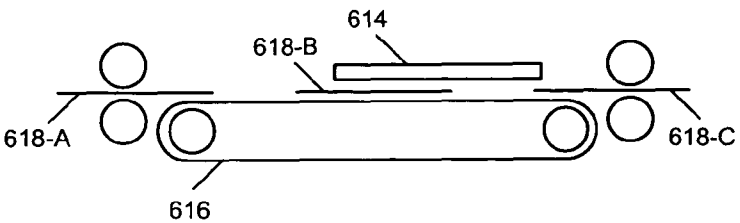

FIG. 6A shows a schematic of a printing system that combines a paper transport system and a carrier 602 that has printing cartridges disposed thereon in the manner described above. Specifically, a belt 604 transports a web of paper 606 past the carrier 602, which is mounted vertically. The carrier 602 and belt 604 are positioned such that the printing cartridges may eject drops of ink onto the paper as the paper is transported. FIG. 6B shows a similar configuration to FIG. 6A and comprises the carrier 602 and the belt 604 arranged such that the web of paper 606 is transported horizontally therebetween. FIG. 6C shows an arrangement for printing on sheets of paper, where a carrier 614 is mounted opposite a belt 610, which transports sheets of paper 618 A-C past the carrier. As each sheet moves past the printing cartridges that comprise the carrier, the printing cartridges are controlled to eject ink.

Figure 7A:
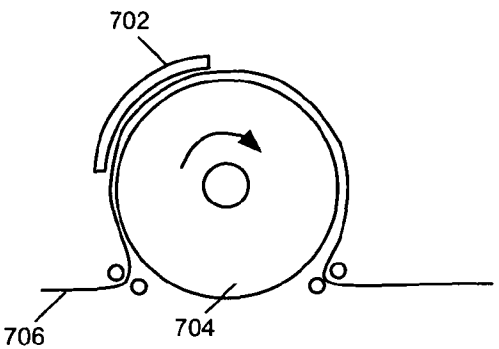
FIGS. 7A-B are schematic diagrams of additional embodiments of printing systems that use the embodiments of the carrier depicted in FIGS. 1-5.
Figure 7B:
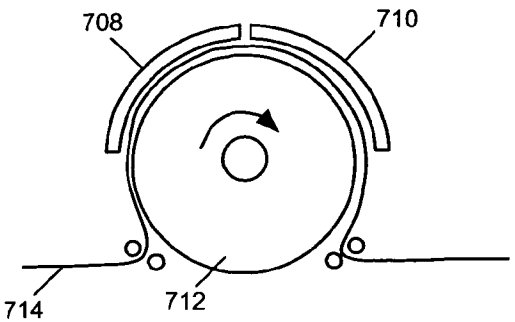

FIG. 7A shows a carrier 702 that is curved (e.g., a section of a cylinder) instead of planer. The printing cartridges are disposed on the carrier 702 as described above. The carrier 702 and a drum (or cylinder) 704 are positioned such that a web of paper 706 may be transported therebetween. Specifically, rotation of the drum 704 urges the web paper 706 to move in the rotational direction and the printing cartridges comprising the carrier 702 are controlled to eject ink onto the paper to produce an image. FIG. 7B shows an arrangement of a first carrier 708 and a second carrier 710 about a drum 712. The paper is transported between the first and second carriers 708 and 710, respectively, and the drum. The printing cartridges that comprise the first carrier 708 eject ink onto a portion of the web of paper 714. The printing cartridges that comprise the second carrier 710 then eject inks onto the same portion of the web of paper 714 when that portion is positioned between the second carrier 710 and the drum. If the printing cartridges that comprise the first carrier 708 are supplied with a first ink color and the printing cartridges that comprise the second carrier 710 are supplied with a second ink color, then the configuration of FIG. 7B enables printing of images that have two colors. It should be apparent that additional drum/carrier combinations similar to those shown in FIG. 7B may be used subsequently to print images having than more two colors onto the web of paper.

Details of the mechanical and electrical control systems required enabling the systems shown in FIGS. 6A-C and FIGS. 7A-B are known to those skilled in the art.

Referring once again to FIG. 3, in some embodiments, all of the printing cartridges 302 A-F and 304 A-F are supplied with ink having the same color. In other embodiments, the group of cartridges 302 A-F supplied with ink having a first color and 304 A-F may be supplied with ink having a second color. Similarly, in some embodiments a single control system receives a line of image data (e.g., a raster line) and coordinates the ejection of ink accordingly from all of the cartridges mounted on the carrier 300 to reproduce the line on the substrate 306. In other embodiments, a first control system and a second control system each receive a line of image data. The first control system coordinates ejection of ink from a first group of printing cartridges (e.g., print cartridges 302 A-F) in accordance with the line of image data and the second control system coordinates ejection of ink from a second group of printing cartridges (e.g., printing cartridges 304 A-F) in accordance with the line of image data. In yet another embodiment, a first control system receives a first portion of the line of image data and coordinates the ejection of ink from the first group of printing cartridges in accordance therewith. In this embodiment, the second control system receives a second portion of the line of image data and coordinates the ejection of ink from the second group of printing cartridges in accordance with the second portion.

Figure 8:
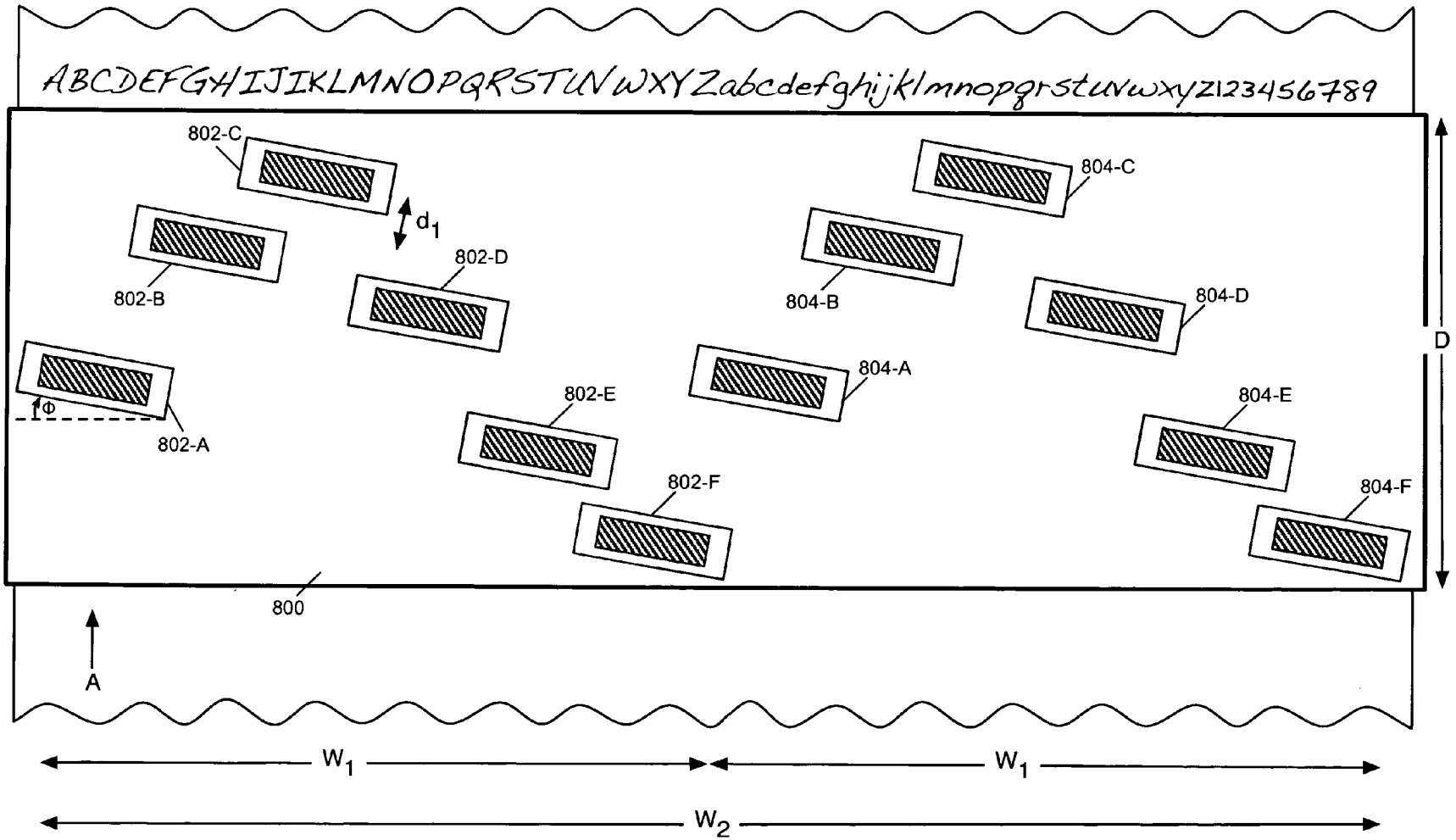
FIG. 8 depicts still another embodiment of a carrier on which printing cartridges are arranged.

FIG. 8 shows an embodiment of a carrier 800 having printing cartridges 802 A-F and 804 A-F arranged thereon. This embodiment is similar to that shown in FIG. 3, except that the individual printing cartridges 802 A-F and 804 A-F are mounted at an angle $\phi$ with respect to a perpendicular to the transport direction A of the substrate. This arrangement allows the resolution of the image printed by the printing cartridges to be increased. The value of the angle $\phi$ depends on the printing cartridge being used. The manufacturer of the printing cartridge may recommend particular values of $\phi$ that may be used to print images at various resolutions. For example, in one embodiment positioning the printing cartridges at an angle $\phi$ that is between 1.5° and 3° that results in an output resolution of between 600 dots-per-inch (dpi) in the paper transport direction (arrow A) and 300 dpi across the width of the substrate and 600 dpi in both the paper transport direction and the paper width direction.

Furthermore, mounting the printing cartridges 802 A-F and 804 A-F at an angle also reduces the transient ink supply necessary to each printing cartridge. In particular, if the printing cartridges 802 A-F and 804 A-F are not mounted at an angle (that is, nozzles of these cartridges are collinear with a direction perpendicular to the transport direction of the substrate), then all of the nozzles that comprise a particular print cartridge must be eject ink simultaneously. However, mounting the cartridges at an angle requires only a portion of the nozzles of a particular ink cartridge to eject ink. Reducing the number of nozzles of a printing cartridge that must simultaneously eject a drop of ink reduces both the transient ink supply requirements to the printing cartridge and also the transient power required to force ejection of ink drops from the nozzles of the printing cartridge.

Figure 9:
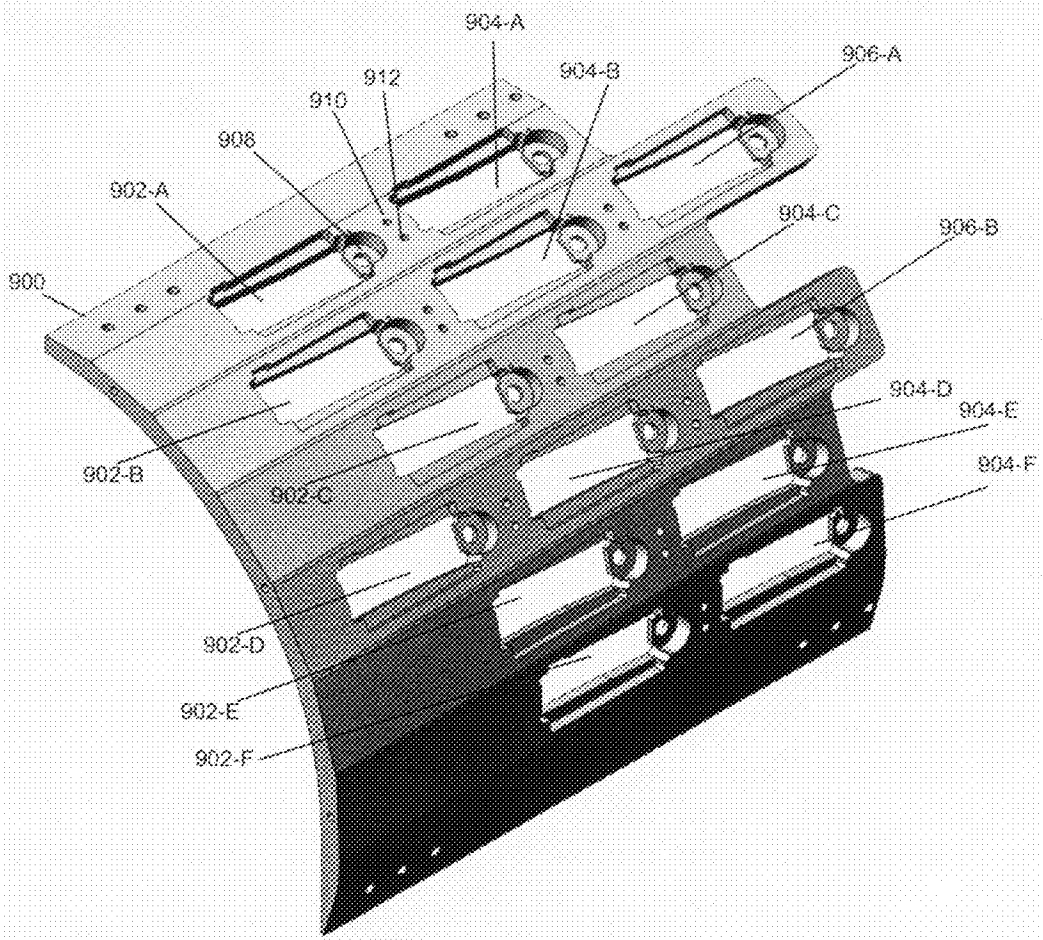
FIG. 9 shows of a curved carrier that has slots therein for mounting printing cartridges.

In one embodiment, the carriers described herein above are milled at a high precision from a block of steel and are tempered to be thermally stable. In other embodiments, the carrier is made out of carbon fiber. In still other embodiments, the carrier Invar (an alloy of iron and nickel) is used to manufacture the carrier. Other materials suitable for manufacturing the carrier will be apparent to those skilled in the art. The arrangements of printing cartridges shown in the figures and described above are locations where printing cartridges may be mounted and provided as templates to show the position of one printing cartridge relative to another. Such positions would be positions where slots are cut into the carrier, and the printing cartridges would be secured into the slots using mounting screws. FIG. 9 shows an embodiment of a portion of a carrier 900 that is curved. The carrier 900 comprises a first group of slots 902 A-F for allow mounting a first group of six printing cartridges and a second group of slots 904 A-F for mounting a second group of six printing cartridges. The portion of the carrier 900 shown FIG. 9 also comprises slots 906-A and 906-B that are part of the third group of slots. The remaining slots of the third group are not shown. The carrier also comprises mounting holes 908, 910, and 910 for mounting and aligning a printing cartridge that is urged into the slot 902-A. Typically, screws are used to secure the printing cartridge into the slot. Holes similar to 908, 910, and 912 are associated with the remaining slots.

The arrangements described above may be used with any type of printing cartridge including those used for desktop ink jet printer, ink jet plotters, industrial ink jet printers, etc. It should be apparent that the embodiments described above are not limited to use with ink jet cartridges, but may be used with other types of printing technologies where image data is stitched across multiple cartridges. For example, the arrangements described above may be used to arrange heads that are used to change magnetic flux on an imaging drum used in magnetography. Similarly, imaging heads may be arranged as described above to expose an imaging drum used in xerography.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An apparatus for printing, the apparatus comprising:

a first plurality of printing cartridges comprising at least three cartridges;

a carrier for mounting the first plurality of printing cartridges, wherein the first plurality of printing cartridges are disposed on the carrier in a first and a second group of printing cartridges, wherein the cartridges comprising each group are distributed on the carrier in a two dimensional pattern such that at least two cartridges disposed in each pattern and that print abutting segments of a line along a first dimension are separated in a second dimension by a third cartridge and wherein the pattern in which the cartridges of the first group are distributed is substantially identical to the pattern in which the cartridges of the second group are distributed;

a media transport for moving a substrate parallel to the second dimension; and wherein the maximum number of cartridges separating any two cartridges that print abutting line segments is less than half of the number of the first plurality of printing cartridges.

2. The apparatus of claim 1, wherein the apparatus comprises a second plurality of printing cartridges disposed in a second carrier.

3. The apparatus of claim 2, wherein the first plurality of printing cartridges and the second plurality of printing cartridges print lines of identical colors.

4. The apparatus of claim 2, wherein one of the first plurality of printing cartridges prints a first line and one of the second plurality of printing cartridges prints a second line and wherein the first line and the second line are adjacent.

5. The apparatus of claim 2, wherein the first plurality of printing cartridges prints a first line in a first color and the second plurality of printing cartridges prints a second line in a second color.

6. The apparatus of claim 5, wherein at least a portion of the first line abuts at least a portion of the second line.

7. The apparatus of claim 5, wherein at least a portion of the first line overlaps at least a portion of the second line.

8. The apparatus of claim 1, wherein each of the first plurality of printing cartridges is an ink jet cartridge, wherein the ink jet cartridge comprises a plurality of ink jet nozzles.

9. The apparatus of claim 8, wherein the plurality of ink jet nozzles comprising the ink jet cartridge are not aligned to be perpendicular to the first second dimension.

10. The apparatus of claim 9, wherein the apparatus comprises a control system that coordinates when a nozzle of each ink jet cartridge ejects a drop of ink.

11. The apparatus of claim 9, wherein a majority of the nozzles of the ink jet cartridge do not simultaneously eject drops of ink.

12. The apparatus of claim 1, wherein the first plurality of printing cartridges comprises a mono-color printing cartridge.

13. The apparatus of claim 1, wherein the first plurality of printing cartridges comprises a multi-color printing cartridge.

14. The apparatus of claim 1, wherein the apparatus comprises a control system that receives a row of raster data and coordinates the operation of each printing cartridge in accordance with the row of raster data.

15. The apparatus of claim 1, wherein each printing cartridge is removably mounted on the carrier.

16. The apparatus of claim 1, wherein the carrier is curved.

17. The apparatus of claim 1, wherein the carrier is planar.

* * * * *